US008704743B2

(12) United States Patent
Yao et al.

(10) Patent No.: US 8,704,743 B2
(45) Date of Patent: Apr. 22, 2014

(54) POWER SAVINGS TECHNIQUE FOR LCD USING INCREASED FRAME INVERSION RATE

(75) Inventors: Wei H. Yao, Fremont, CA (US); Shawn Robert Gettemy, San Jose, CA (US)

(73) Assignee: Apple Inc., Cupertino, CA (US)

( * ) Notice: Subject to any disclaimer, the term of this patent is extended or adjusted under 35 U.S.C. 154(b) by 1199 days.

(21) Appl. No.: 12/286,394

(22) Filed: Sep. 30, 2008

(65) Prior Publication Data

US 2010/0079509 A1 Apr. 1, 2010

(51) Int. Cl.
*G09G 3/36* (2006.01)

(52) U.S. Cl.
CPC ..... *G09G 3/36* (2013.01); *G09G 2330/021* (2013.01)
USPC ..... 345/98; 345/204

(58) Field of Classification Search
USPC ..... 345/204, 87–104
See application file for complete search history.

(56) References Cited

U.S. PATENT DOCUMENTS 5,241,541 A * 8/1993 Farrell et al. ..... 370/438
5,576,737 A * 11/1996 Isozaki ..... 345/211
5,978,303 A * 11/1999 Takasugi et al. ..... 365/230.03
6,335,778 B1 * 1/2002 Kubota et al. ..... 349/151
6,385,240 B2 * 5/2002 Nishio ..... 375/240
6,476,822 B1 * 11/2002 Burbank ..... 345/634
2002/0000969 A1 * 1/2002 Ozawa ..... 345/100
2002/0004413 A1 * 1/2002 Inoue ..... 455/566
2002/0015104 A1 * 2/2002 Itoh et al. ..... 348/459
2002/0126083 A1 * 9/2002 Cairns et al. ..... 345/98
2003/0140347 A1 * 7/2003 Varsa ..... 725/90
2006/0092320 A1 * 5/2006 Nickerson et al. ..... 348/441
2006/0238486 A1 * 10/2006 Hiraki ..... 345/102
2007/0018928 A1 1/2007 Ludden
2007/0153007 A1 * 7/2007 Booth et al. ..... 345/501
2008/0048966 A1 2/2008 Liao et al.
2008/0062139 A1 3/2008 Hotelling et al.
2009/0028109 A1 * 1/2009 Huang et al. ..... 370/330
2009/0073311 A1 * 3/2009 Hamada et al. ..... 348/441

* cited by examiner

*Primary Examiner* — Dorothy Harris
(74) *Attorney, Agent, or Firm* — Fletcher Yoder PC

(57) ABSTRACT

A method and system is disclosed for minimizing parasitic losses associated with a liquid crystal display (LCD) of a device. A frame buffer may be used in conjunction with a driver circuitry integrated circuit. The frame buffer may store a set of display values for the LCD so that the display values corresponding to a plurality of frames may be transmitted together from a processor in a burst. Once the values are transmitted, the processor may idle or hibernate. Alternatively, only the changes to an image may be transmitted from the processor to the driver circuitry. The remaining pixel values may be drawn based on values previously stored in the frame buffer. Furthermore, the driver circuitry may be used to step up the received display rate values to a level that allows for inversion of the polarity of pixels in the LCD using frame inversion.

24 Claims, 5 Drawing Sheets

POWER SAVINGS TECHNIQUE FOR LCD USING INCREASED FRAME INVERSION RATE

The present disclosure relates generally to refreshing the pixels of a liquid crystal display.

DESCRIPTION OF THE RELATED ART

This section is intended to introduce the reader to various aspects of art that may be related to various aspects that are described and/or claimed below. This discussion is believed to be helpful in providing the reader with background information to facilitate a better understanding of these various aspects. Accordingly, it should be understood that these statements are to be read in this light, and not as admissions of prior art.

Electronic devices increasingly include display screens as part of the user interface of the device. As may be appreciated, the display screens may be employed in a wide array of devices, including desktop computer systems, notebook computers, and handheld computing devices, cellular phones and portable media players. Liquid crystal display (LCD) panels have become increasingly popular for use in these devices. This popularity can be attributed to their light weight and thin profile, as well as the relatively low power it takes to operate the pixels of the LCD's to generate images on the LCD.

For any given pixel of an LCD monitor, the amount of light that is viewable on the LCD depends on the voltage applied to the pixel. However, applying a single direct current (DC) voltage could eventually damage the pixels of the display. Thus, in order to prevent such possible damage, LCD's typically alternate, or invert, the voltage applied to the pixels between positive and negative DC values for each pixel. This inversion results in an overall average DC voltage of zero over time, with no loss in brightness because the root mean square of the voltage can be chosen to be the same for both the positive and negative DC values.

This inversion is typically done on a line by line basis to refresh the voltage of the LCD, creating line inversion refreshes for the LCD. Similarly, LCDs typically refresh an image by stepping through a line horizontally and transmitting the necessary voltage to each pixel, in effect, redrawing the image from scratch for the LCD on a line by line basis. The combination of line refreshing and line by line image redrawing of images can cause an LCD to deplete the power source in portable electronic device. Accordingly, as the demand for portable devices continues to grow, there is a need for LCD inversion techniques and image refreshing techniques that consume less power.

SUMMARY

Certain aspects of embodiments disclosed herein by way of example are summarized below. It should be understood that these aspects are presented merely to provide the reader with a brief summary of certain embodiments and that these aspects are not intended to limit the scope of the claims. Indeed, the disclosure and claims may encompass a variety of aspects that may not be set forth below.

A method and system is disclosed for implementing a frame buffer for use with a liquid crystal display (LCD). The frame buffer may be used in conjunction with a driver circuit integrated circuit. The frame buffer may store the current voltage values associated with an image displayed on the LCD. As these current values are read out of the frame buffer and used to generate images on the LCD, new voltage values may be transmitted to the frame buffer to replace the current values. These new voltage values may be transmitted via a burst whereby the driver circuit receives, for example, twice as much data during half the amount of time as if the data was sent continuously. The driver circuit may store the received data corresponding to images to be displayed on the display. By transmitting values in a burst, the CPU may idle until another burst of voltage values are required by the driver circuitry. In another embodiment, only changes to voltage values associated with an image are transmitted to the LCD while the prior unchanged voltage values may be retrieved from the frame buffer. Additionally, the driver circuitry may be used to invert the polarity of pixels in the LCD using a frame inversion method instead of a traditional line inversion method, leading to power consumption reductions through reduced LCD transitions from an on to an off state. This may be accomplished by performing frame inversion at a rate higher than that transmitted from the CPU.

BRIEF DESCRIPTION OF THE DRAWINGS

Certain embodiments may be understood reading the following detailed description and upon reference to the drawings in which like characters represent like parts throughout the drawings, wherein.

DETAILED DESCRIPTION OF SPECIFIC EMBODIMENTS

One or more specific embodiments will be described below. In an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to inclusion of a frame buffer for use with an LCD. The frame buffer may allow for buffering of voltage values transmitted via a burst. In this manner, the processor used to transmit signals to the LCD may remain idle as values are read from the frame buffer instead of being continuously received from the processor. For example, in a burst, 600 Mbits of data may be transmitted from the processor during a first time, $T_1$, while the processor idles during a second time, $T_2$. Contrast this with a continuous transmission whereby, for example, 600 Mbits of data is transmitted, with 300 Mbits of data being transmitted during $T_1$ and 300 Mbits of data being transmitted during $T_2$. Allowing the processor to idle during $T_2$ may utilize less power than continuous transmission by the processor. Moreover, LCD drive circuitry may be used for frame inversion techniques for refreshing the display of the LCD. Using the circuitry and techniques outlined above may result in a reduction of power consumed by the LCD from about 50 to 100 milliwatts (mW) to a level of about half, through the use of low power consuming frame buffer circuitry. Additionally the use of frame inversion techniques instead of line inversion techniques may reduce panel power consumption by an additional 25% with frame refresh. Thus, the power consumed by the electronic device in which the LCD resides can be reduced.

Figure 1:
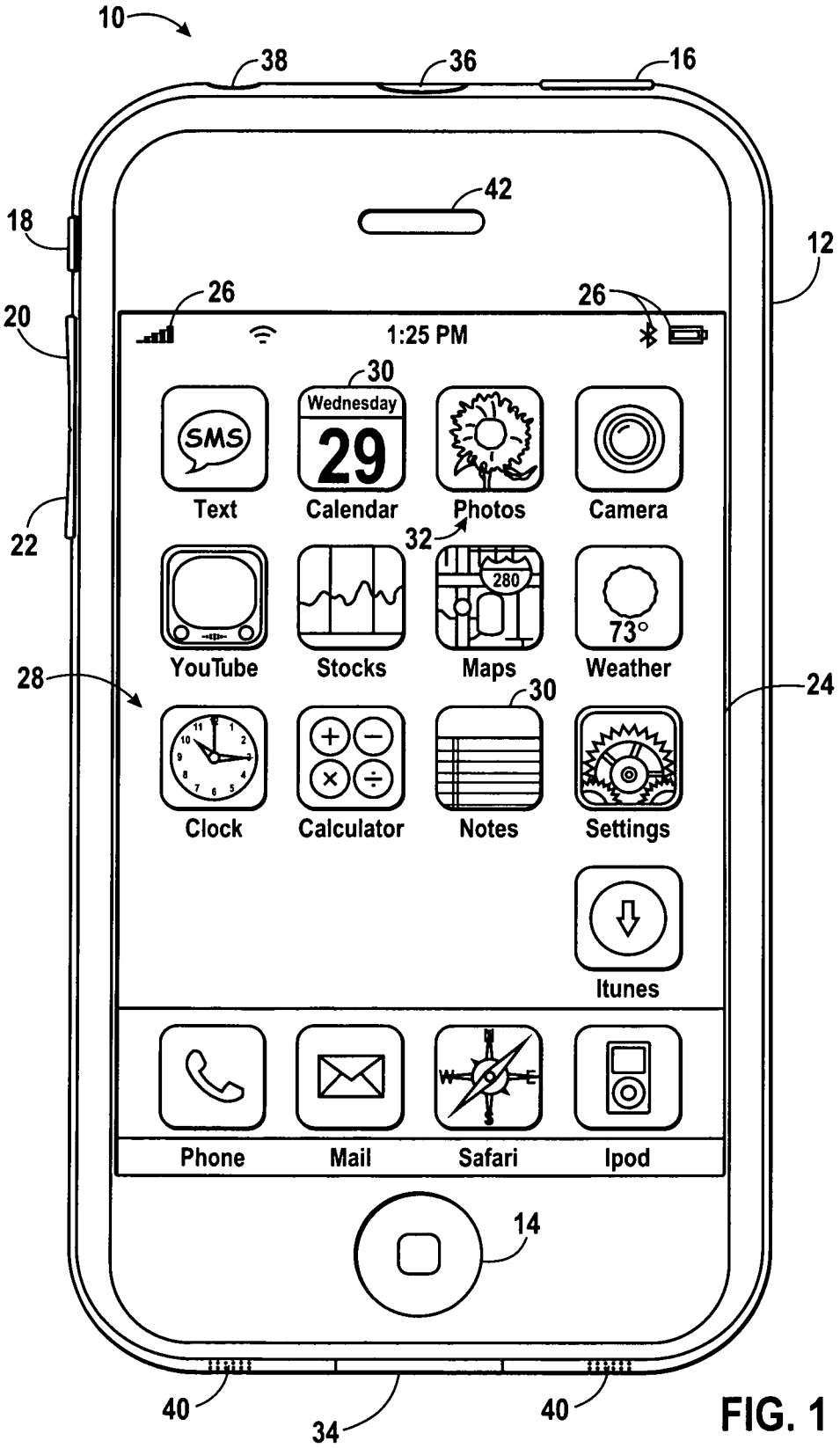
FIG. 1 is a front view of an electronic device, such as a portable media player, in accordance with one embodiment.

Turning now to the figures, FIG. 1 illustrates an electronic device 10 that may be a handheld device incorporating the functionality of one or more portable devices, such as a media player, a cellular phone, a personal data organizer, and so forth. Depending, of course, on the functionalities provided by the electronic device 10, a user may listen to music, play games, record video, take pictures, and place telephone calls, while moving freely with the device 10. In addition, the electronic device 10 may allow a user to connect to and communicate through the Internet or through other networks, such as local or wide area networks. For example, the electronic device 10 may allow a user to communicate using e-mail, text messaging, instant messaging, or other forms of electronic communication. The electronic device 10 also may communicate with other devices using short-range connections, such as Bluetooth® and near field communication. By way of example, the electronic device 10 may be a model of an iPhone® available from Apple Inc. of Cupertino, Calif.

In the depicted embodiment, the device 10 includes an enclosure 12 that protects the interior components from physical damage and shields them from electromagnetic interference. The enclosure 12 may be formed from any suitable material such as plastic, metal, or a composite material and may allow certain frequencies of electromagnetic radiation to pass through to wireless communication circuitry within the device 10 to facilitate wireless communication.

The enclosure 12 allows access to user input structures 14, 16, 18, 20, and 22 through which a user may interface with the device. Each user input structure 14, 16, 18, 20, and 22 may be configured to control a device function when actuated. For example, the input structure 14 may include a button that when pressed causes a "home" screen or menu to be displayed on the device. The input structure 16 may include a button for toggling the device 10 between a sleep mode and a wake mode. The input structure 18 may include a two-position slider that silences a ringer for the cell phone application. The input structures 20 and 22 may include buttons for increasing and decreasing the volume output of the device 10. In general, the electronic device 10 may include any number of user input structures existing in various forms including buttons, switches, control pads, keys, knobs, scroll wheels, or other suitable forms.

The device 10 also includes a display 24 which may display various images generated by the device. For example, the display 24 may show photos, movies, album art, and/or data, such as text documents, spreadsheets, text messages, and email, among other things. The display 24 also may display system indicators 26 that provide feedback to a user, such as power status, signal strength, call status, external device connection, and the like. The display 24 may be any type of display such as a liquid crystal display (LCD), a light emitting diode (LED) display, an organic light emitting diode (OLED) display, or other suitable display. Additionally, the display 24 may include a touch-sensitive element, such as a touch screen.

The display 24 may be used to display a graphic user interface (GUI) 28 that allows a user to interact with the device. The GUI 28 may include various layers, windows, screens, templates, elements, or other components that may be displayed in all, or a portion, of the display 24. Generally, the GUI 28 may include graphical elements that represent applications and functions of the device 10. The graphical elements may include icons and other images representing buttons, sliders, menu bars, and the like. In certain embodiments, the user input structure 14 may be used to display a home screen of the GUI 28. For example, in response to actuation of the input structure 14, the device may display graphical elements, shown here as icons 30, of the GUI 28. The icons 30 may correspond to various applications of the device 10 that may open upon selection of an icon 30. The icons 30 may be selected via a touch screen included in the display 24, or may be selected by user input structures, such as a wheel or button.

The icons 30 may represent various layers, windows, screens, templates, elements, or other components that may be displayed in some or all of the areas of the display 24 upon selection by the user. Furthermore, selection of an icon 30 may lead to a hierarchical navigation process, such that selection of an icon 30 leads to a screen that includes one or more additional icons or other GUI elements. Textual indicators 32 may be displayed on or near the icons 30 to facilitate user interpretation of each icon 30. It should be appreciated that the GUI 30 may include various components arranged in hierarchical and/or non-hierarchical structures.

When an icon 30 is selected, the device 10 may be configured to open an application associated with that icon and display a corresponding screen. For example, when the Weather icon 30 is selected, the device 10 may be configured to open a weather application with a user interface that may provide the current weather conditions to a user. Indeed, for each icon 30, a corresponding application that may include various GUI elements may be opened and displayed on the display 24.

The electronic device 10 also may include various input and output (I/O) ports 34, 36, and 38 that allow connection of the device 10 to external devices. For example, the I/O port 34 may be a connection port for transmitting and receiving data files, such as media files. Furthermore, the I/O port 34 may be a proprietary port from Apple Inc. The I/O port 36 may be a connection slot for receiving a subscriber identify module (SIM) card. The I/O port 38 may be a headphone jack for connecting audio headphones. In other embodiments, the device 10 may include any number of I/O ports configured to connect to a variety of external devices, including but not limited to a power source, a printer, and a computer. In other embodiments, multiple ports may be included on a device. Additionally, the ports may be any interface type, such as a universal serial bus (USB) port, serial connection port, Firewire®, (IEEE-1394) port, or AC/DC power connection port.

The electronic device 10 may also include various audio input and output structures 40 and 42. For example, the audio input structures 40 may include one or more microphones for receiving voice data from a user. The audio output structures 42 may include one or more speakers for outputting audio data, such as data received by the device 10 over a cellular network. Together, the audio input and output structures 40 and 42 may operate to provide telephone functionality. Further, in some embodiments, the audio input structures 40 may include one or more integrated speakers serving as audio output structures for audio data stored on the device 10. For example, the integrated speakers may be used to play music stored in the device 10. Additional details of the illustrative device 10 may be better understood through reference to FIG. 2, which is a block diagram illustrating various components and features of the device 10 in accordance with one embodiment of the present invention.

Figure 2:
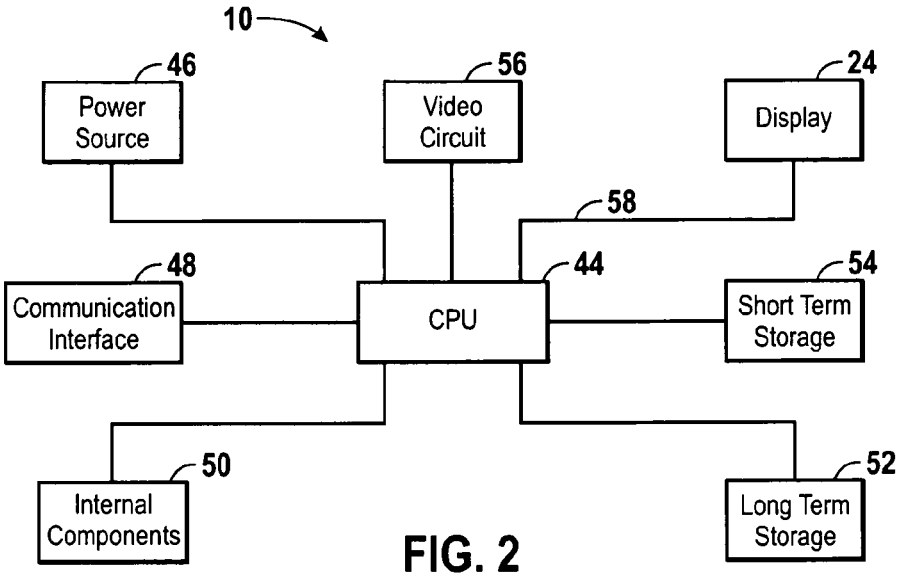
FIG. 2 is a block diagram of internal components of the electronic device of FIG. 1.

FIG. 2 is a block diagram that illustrates the components that may be utilized by the electronic device 10 to operate. In the presently illustrated embodiment, the device 10 may include the elements described in reference to FIG. 1, such as the display 24. In addition, as discussed in greater detail below, the electronic device 10 may include includes a central processing unit (CPU) 44, a power source 46, a communications interface 48, internal components 50, long-term storage 52, short term storage 54, and video circuitry 56.

As set forth above, the electronic device 10 may include a CPU 44. The CPU 44 may include a single processor or it may include a plurality of processors. For example, The CPU 44 may also include one or more "general-purpose" microprocessors, a combination of general and special purpose microprocessors, and/or ASICS, as well as one or more reduced instruction set (RISC) processors, graphics processors, video processors, and/or related chip sets. The CPU 44 may provide the processing capability to execute the operating system, programs, the GUI 28, and any other functions of the device 10.

The electronic device 10 also may include a power source 46. The power source 46 may be used to power the electronic device 10 via, for example, one or more batteries, such as a Li-Ion battery, which may be user-removable or secured to the enclosure 12 and, which may be rechargeable. Additionally, the power source 46 may be connected to an I/O port that alternately allows for the power source 46 to receive power from an external AC or a DC power source, such as an electrical outlet or a car cigarette lighting mechanism.

The electronic device 10 may further include a communication interface 48. The communication interface 48 may include one or more connectivity channels for receiving and transmitting information between the device 10 and, for example, an external network. For example, the device 10 may connect to a personal computer via the communication interface to send and receive data files, such as media files. The communication interface 48 may represent, for example, one or more network interface cards (NIC) and/or a network controller, as well as associated communication protocols. The communication interface 48 may also include several types of interfaces, including but not limited to, a local area network (LAN) interface for connection to, for example, a wired Ethernet-based network wireless or a wireless LAN, such as an IEEE 802.11x wireless network, a wide area network (WAN) interface for connection to, for example, a cellular data network, such as the Enhanced Data rates for GSM Evolution (EDGE) network or the 3G network, and/or a personal area network (PAN) interface for connection to, for example, a Bluetooth® network. Use of these interfaces may allow the device 10 to, for example, make and receive phone calls, access the internet, and/or transmit and receive real-time text messages.

The electronic device 10 may also include internal components 50. The internal components 50 may include sub-circuits that perform specialized functions of the electronic device 10. These internal components 50 may include, for example, phone circuitry, camera circuitry, and audio circuitry. The phone circuitry may allow a user to receive or make a telephone call through user interaction with the audio input and output structures 40 and 42. The camera circuitry may allow a user to take digital photographs. Additionally, the audio circuitry may be used in the playing of audio files such as compressed music files.

The electronic device 10 may further long term storage 52. The long-term storage 52 of electronic device 10 may be used for storing data utilized for the operation of the CPU 44, as well as other components of the device 10, such as the communications interface 48 and/or the internal components 50. For example, the long term storage 52 may store the firmware for the electronic device 10 usable by the CPU 44, such as an operating system, other programs that enable various functions of the electronic device 10, user interface functions, and/or processor functions. Additionally, the long term storage 52 may store data files such as media (e.g., music and video files), image data, software, preference information (e.g., media playback preferences), wireless connection information (e.g., information that may enable the device 10 to establish a wireless connection, such as a telephone connection), subscription information (e.g., information that maintains a record of podcasts, television shows or other media to which a user subscribes), telephone information (e.g., telephone numbers), and any other suitable data. The long term storage 52 may be non-volatile memory such as read only memory (ROM), flash memory, a hard drive, or any other suitable optical, magnetic, or solid-state storage medium, as well as a combination thereof.

In addition to the long term storage 52, the device 10 may include short term storage 54. The short term storage 54 may include volatile memory, such as random access memory (RAM), and may be used to store a variety of information. For example, the CPU 44 may use the short term storage 54 for buffering or caching data during operation of the device 10.

The device 10 may also include video circuitry 56. The video circuitry 56 may be used, for example, to encode and decode video samples taken by the user in conjunction with the camera circuitry or downloaded from an external source such as the internet. The video circuitry 56 may also be used by the CPU 44 for processing other images for viewing on the display 24. For example, the video circuitry 56 may process media data for viewing on the display 24. Additionally, the CPU 44 may instead retrieve the image data from the communication interface 48, from one or more of the internal components 50, from the long-term storage 52, and/or from the short-term storage 54 prior to transmitting image data to the display 24 across a data path 58 capable of transferring the image data to the display 24.

The data path 58 may include a high speed data connection used for transmitting rapidly changing image data, such as video data, to the display 24. The high speed data connection may typically be used to transmit up to 300 Mbits of data per second. The data path 58 may also include a low speed data connection typically used to transmit up to 10 Mbits of data per second. The low speed data connection may be utilized to transmit control signals between the display 24 and the CPU 44. Additionally, the low speed data connection may be utilized to transmit, for example, image data associated with slowly changing image data, such as images associated with a text message. The data path 58 may be a serial link such as a Mobile Industry Processor Interface (MIPI) link.

Figure 3A:
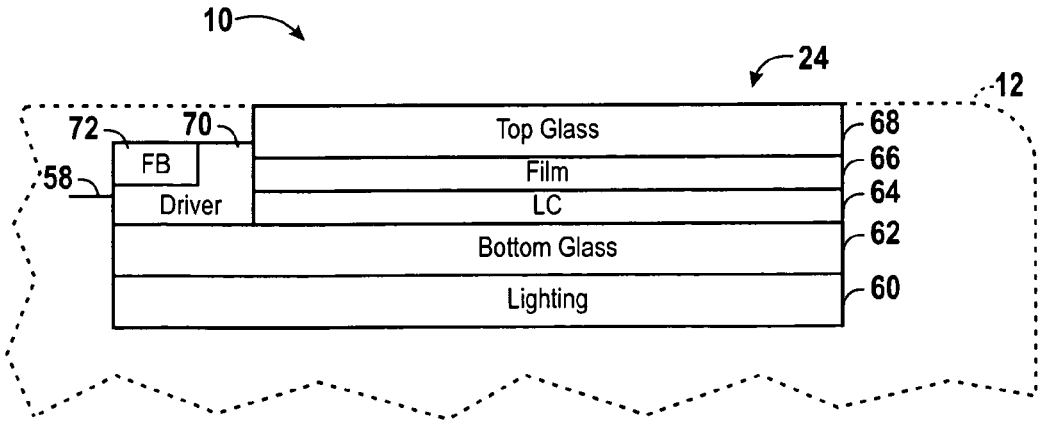
FIG. 3A is a side view of the display of FIGS. 1 and 2.
Figure 3B:
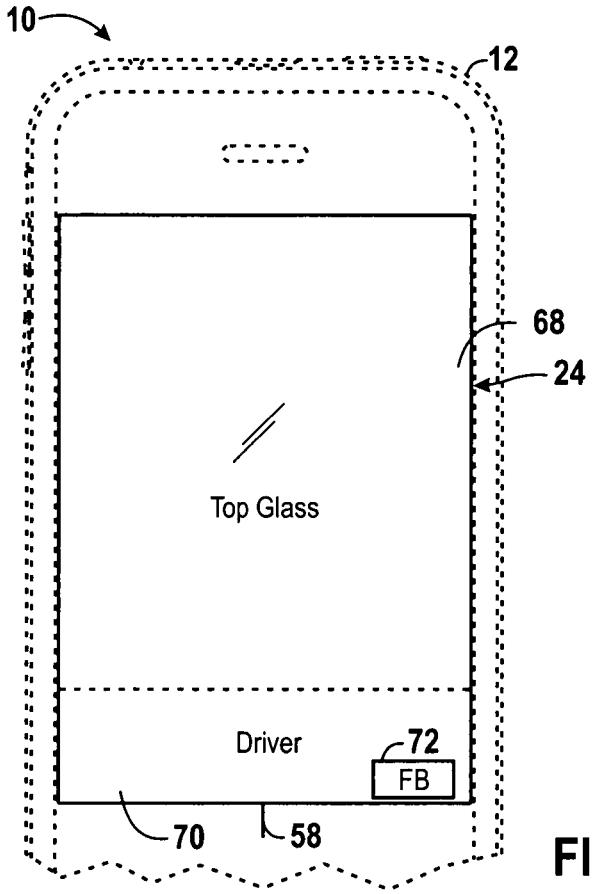
FIG. 3B is a top view of the display of FIGS. 1 and 2.

A side view of a display 24 of device 10 that includes components used in creating an image in conjunction with CPU 44 is illustrated in FIG. 3A. A top view of this same display 24 is illustrated in FIG. 3B. The display 24 may include lighting circuitry 60, a bottom glass 62, liquid crystals 64, a film 66, a top glass 68, a driver circuit 70, and a frame buffer 72.

The lighting circuitry 60 may be used to provide a light source for the display 24. The lighting circuitry 60 may include one or more of elements that are used in the creation and initial filtering of light for the display 24. Specifically, the lighting circuitry 60 may include a light source such as light emitting diodes (LEDs). The LEDs may be arranged on a printed circuit board (PCB) adjacent to a guide plate (not shown), which may act to channel the light emanating from the light source upwards towards bottom glass 62. Alternatively, the LED's may be arranged on one or more PCBs beneath the guide plate. The lighting circuitry 60 may also include a diffuser plate (not shown) that may diffuse the light being passed to the bottom glass 62. The diffuser plate may assist in reducing glaring and non-uniform illumination on the display 24. The lighting circuitry 60 may also include optical sheets (not shown) that may polarize the light emanating form the light source to the bottom glass 62.

As discussed above, the lighting circuitry 60 provides illumination for the display 24 by transmitting light to the bottom glass 62. The bottom glass 62 may be patterned to provide a boundary for the liquid crystals 64. This patterning of the bottom glass 62 may include the use of various conductive materials such as thin film transistors (TFTs). As will be described below, these TFTs may act as electrodes that allow for varying voltage to be applied to the liquid crystals 64, thus altering the alignment of the liquid crystals 64 to allow differing amounts of light to pass through the liquid crystals 64, as described below.

The liquid crystals 64 may be a substance that exhibits both liquid and crystalline properties. Depending on the orientation of the molecules of the liquid crystals 64, differing amounts of light may pass through the liquid crystals 64. One manner of altering the orientation of the molecules of the liquid crystals 64 includes creating an electric field by applying voltages to the liquid crystals 64. The molecules of the liquid crystals 64 may change their alignment in response to the electric field, thus modifying the amount of light that may be transmitted through the liquid crystals 64 to the pixels of the display 24. In this manner, and through the use of various color filters to create colored sub-pixels, color images may be represented on across individual pixels of the display 24 in a pixilated manner.

The liquid crystals 64 may be adjacent to a layer of film 66. The film 66 may be composed of indium-tin oxide (ITO), which is a conductive and optically transparent material. Much like the TFTs described above, the film 66 may be partitioned into rows and columns to allow for voltage to be transmitted to the liquid crystals 64. This voltage, $V_{COM}$, may be modulated to allow for inversion of the display pixels, which may be part of the top glass 68.

The top glass 68 may provide an upper boundary for the display 24 and may protect the film 66, the liquid crystals 64, and the bottom glass 62. The top glass 68 may also be patterned. This pattern may include one or more color filters (not shown) that may be used to filter the light passing through the liquid crystals 64 to create the desired colors on the pixels of the display 24. In this manner, color images may be represented on across individual pixels of the display 24 in a pixelated manner.

As previously discussed, the display 24 may perform pixel inversion to reduce the long term degradation of the display 24 caused by pixel exposure to direct current voltage. Likewise, power consumption of the display 24 will typically be kept to a minimum so that the display 24 can be effectively incorporated into portable electronic devices 10. To meet the aforementioned requirements, the display 24 may incorporate driver circuitry 70 for frame inversion and a frame buffer 72 for low power image generation.

Figure 4:
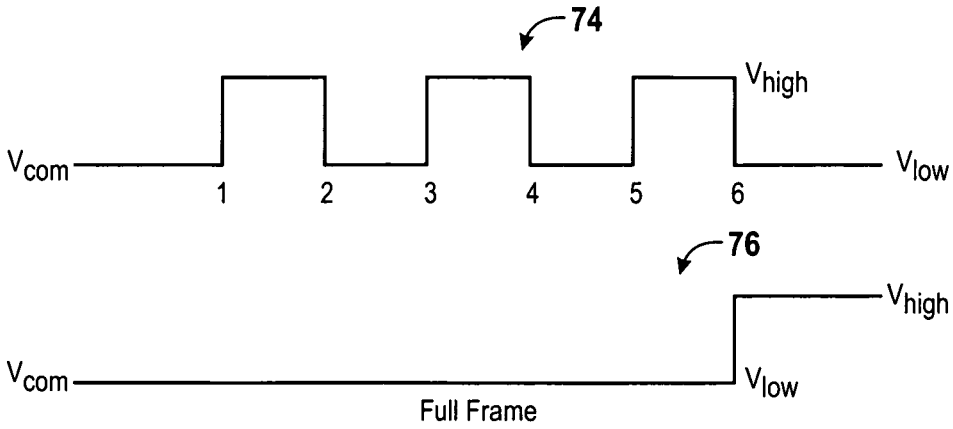
FIG. 4 is a timing diagram illustrating two methods of pixel inversion as performed by the driver circuitry of FIGS. 3A and 3B.

The driver circuitry 70 may be an integrated circuit that controls operation of the display 24. The driver circuitry 70 may be used to manage the lighting circuitry 60 by controlling the power that is transmitted to a light source in the lighting circuitry 60. The driver circuitry 70 may also generate a $V_{COM}$ voltage signal that is used for inversion of the display 24 pixels via film 66. The film 66 acts like a capacitor, so that every time $V_{COM}$ is switched from high to low, or vice versa, the film 66 resists the change in voltage. Accordingly, every switch of $V_{COM}$ requires power to overcome the stored capacitance of the film 66 to timely get the $V_{COM}$ to the proper level. FIG. 4 illustrates two methods for modulation of $V_{COM}$.

The first method of modulation of $V_{COM}$, as illustrated by graph 74 of FIG. 4, is a line inversion method that includes switching $V_{COM}$ from a high voltage, $V_{HIGH}$, to a low voltage, $V_{LOW}$, on a line by line basis in the display 24. As discussed above, power is consumed to overcome the stored capacitance of the film 66 for every switch between $V_{HIGH}$ and $V_{LOW}$. Contrast this with the second method of modulation of $V_{COM}$, illustrated by the graph 76, in which a frame inversion method is illustrated that includes switching the polarity of $V_{COM}$ transmitted to all pixels of the display 24 once a frame instead of line by line, i.e., multiple times for each frame. One advantage of the frame inversion method is that modulation of $V_{COM}$ occurs once per frame, thus the capacitance of the film 66 is overcome only once per frame leading to reduced amounts of power used to invert the pixels of the display 24. Since it is the transition from $V_{HIGH}$ to $V_{LOW}$ that causes the most power loss in the display 24, reducing the amount of transitions of $V_{COM}$ to once per frame reduces overall power consumption of the display 24. For example, for a 3.5 inch display that modulates $V_{COM}$ only once a frame instead of line by line, the power consumed drops from about 50-100 mW to about half. Moreover, this frame inversion technique may typically be done at greater than 60 Hz, such as 90 Hz, to reduce visible flicker on the display 24. Other power saving techniques that may be employed by the driver circuitry 70 include the use of the frame buffer 72.

The frame buffer 72 may be used to store the voltage values transmitted across the data path 58 to the driver circuitry 70. The frame buffer 72 may be static random access memory (SRAM) located in the driver circuitry 70 of the display 24, instead of DDR SDRAM, typically located in the CPU 44. Use of SRAM for the buffer 72 may use less power to operate per frame refresh, up to 200-300 mW less than a corresponding DDR SDRAM. Thus, use of an SRAM frame buffer 72 located in the driver circuitry 70 of the display may contribute to overall power savings for the display 24. The frame buffer 72 may also be of a size to hold image data corresponding to a plurality of image frames to be displayed on the display 24.

The driver circuitry 70 and the frame buffer 72 may also operate in conjunction with the CPU 44 to reduce overall power consumption of the electronic device 10. Typically, when the electronic device 10 is being utilized to display rapidly changing data, such as video data, the CPU 44 may transmit data continuously at a rate of 60 Hz. At this speed, typically only a line inversion method of refreshing the display, as described above with respect to graph 72 of FIG. 4, may be performed. Accordingly, as described above in conjunction with graph 74 of FIG. 4, a full frame inversion method may be performed, with corresponding power savings, however to limit flickering on the display 24, the full frame inversion method should be performed at a rate greater than 60 Hz, such as 90 Hz or 120 Hz. However, transmitting data from the CPU 44 at a matching rate to the full frame inversion rate may lead to excess power consumption. Accordingly, FIGS. 5 and 6 illustrate methods for utilizing the full frame inversion method without the CPU 44 continuously transmitting data at a matching rate.

Figure 5:
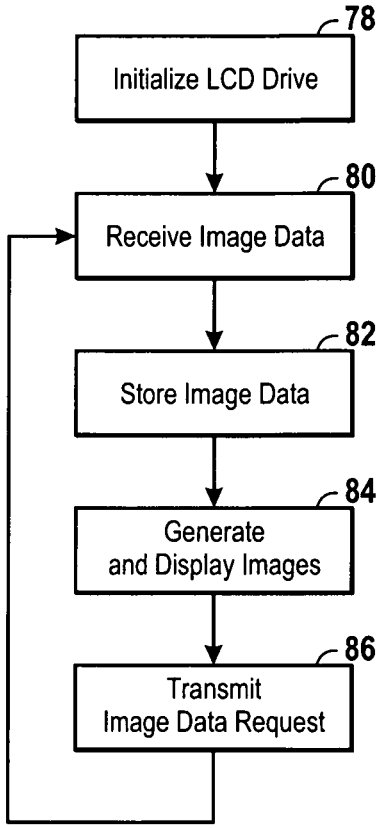
FIG. 5 is a flow chart illustrating a method of utilizing the frame buffer of FIGS. 3A and 3B to display an image.
Figure 6:
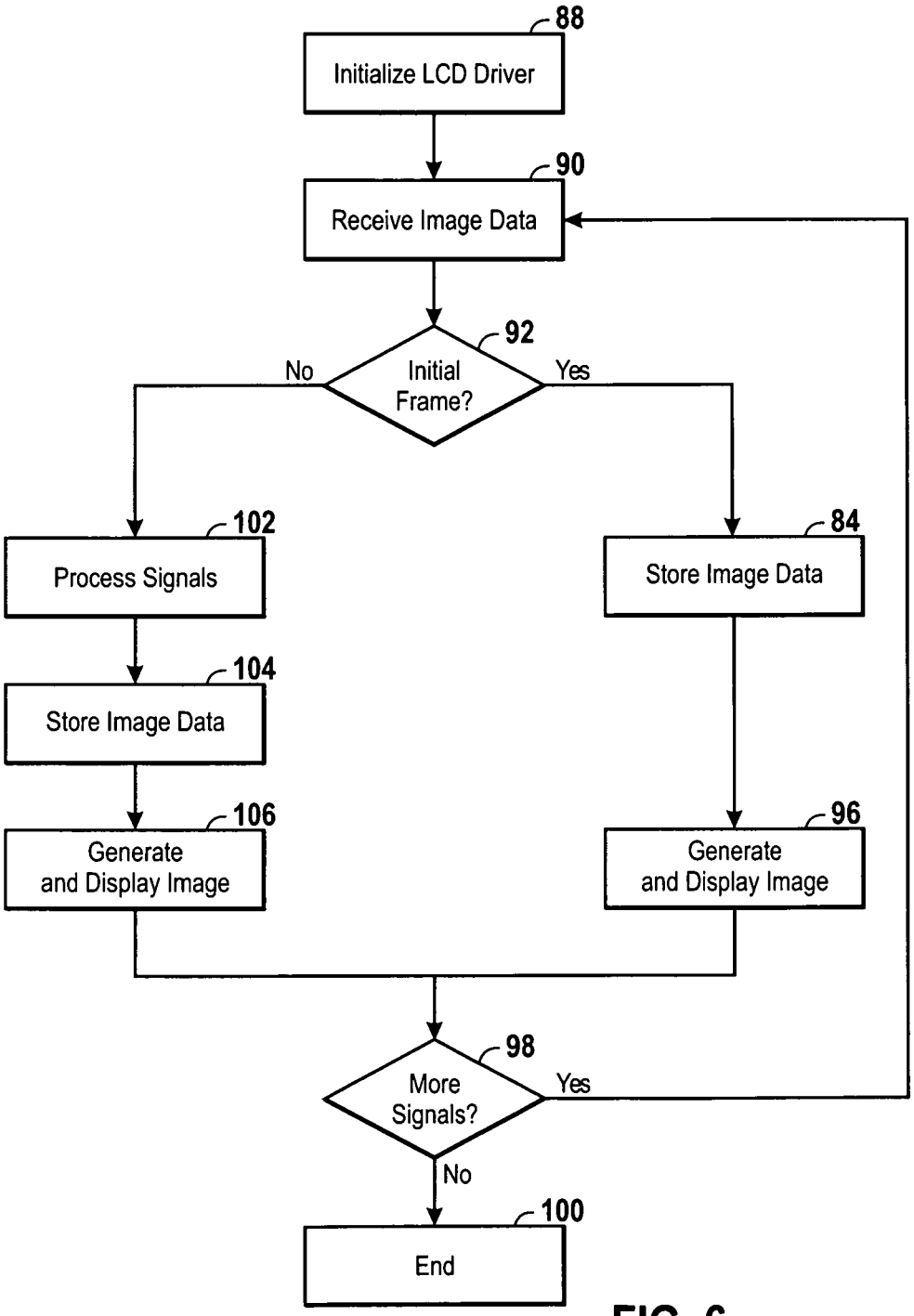
FIG. 6 is a flow chart illustrating a second method of utilizing the frame buffer of FIGS. 3A and 3B to display an image.

FIG. 5 illustrates the steps that may be performed when rapidly changing image data, such as video data, is to be displayed on display 24. In step 78 the driver circuitry 70 may be initialized. This may include the CPU 44 transmitting an activate signal to the driver circuitry 70 to prepare the driver circuitry 70 for receipt of data to be displayed on display 24. Additionally, the initialization of the LCD in step 78 may include transmitting the type of data to be displayed, here rapidly changing image data such as video data, so that the driver circuitry 70 may be placed into the correct display mode. The initialization signals may be transmitted over the low speed data connection of the data path 58.

In step 80, the driver circuitry 70 may receive the image data of the type communicated by the CPU 44 in step 78, for example, rapidly changing image data such as video data. While this data may be transmitted continuously at up to 300 Mbits per second, and at rate equal to a display 24 refresh rate of 60 Hz, this may only allow the display 24 to be refreshed by a line inversion method. As noted above, by transmitting the data in a burst, the same amount of data may be transmitted in half the time as with the continuous data transmission method. Accordingly, the CPU 44 may remain idle when not transmitting in bursts, thus reducing the overall power consumption of the electronic device 10. Therefore, in another embodiment, the rapidly changing image data may be transmitted at a rate equal to a refresh rate of 30 Hz in a burst, whereby 600 Mbits per second of data may be transmitted during the burst, and the driver circuitry may be utilized to step up the refresh rate from 30 Hz to 90 Hz or 120 Hz, as will be described below.

The image data received by the driver circuitry 70 may be stored in the frame buffer 72 in step 82. The driver circuitry 70 may then generate and display images on the display 24 based on the image data stored in the frame buffer 72. As described above, the image data stored from a burst transmission may correspond to video data transmitted at, for example, 30 Hz. However, generating an image at 30 Hz may present visible flickering on the display 24. Moreover, since frame inversion may typically be done at, for example, 90 Hz, the driver circuitry 70 may step up the display rate from the received rate, for example, 30 Hz, to a frame inversion display rate, for example, 90 Hz. In this manner, the CPU 44 may transmit image at a reduced rate such as at 30 Hz, while the display 24 may be updated at a rate sufficient to allow for frame inversion refreshing, such as 90 Hz. Transmitting data from the CPU 44 at a reduced rate, such as 30 Hz, may require less power than transmitting data at a rate that allows for frame inversion, such as 90 Hz. For example, transmit image data from the CPU 44 at 30 Hz instead of at 90 Hz may utilize as much as ⅓ less power.

The driver circuitry 70 may continue to generate and display images based on the image data stored in the frame buffer 72. As the driver circuitry 70 determines that data stored in the frame buffer 72 is to be refreshed with new image data, i.e. the stored image data has already been displayed, the driver circuitry 70 may, in step 86, transmit an image data request along the low speed data connection of the data path 58 to the CPU 44. This image data request may activate the CPU 44 from its idle, whereby the CPU 44 may transmit a new burst of image data to be received by the driver circuitry in step 80. In this manner, the data path 58 acts as an on demand bus for image data to be displayed on the display 24. By triggering the CPU via the demand bus, image artifacts sometimes referred to as image tearing can be avoided.

FIG. 6 illustrates the steps that may be performed when with slowly changing image data, such as images associated with a text message, is to be displayed on display 24. During the reading or writing of a text message, very little new image data may be transmitted to the display 24, since the image on the display is either stagnant or updates at most, one or more text characters per frame. Accordingly, in step 88 the driver circuitry 70 may be initialized. This may include the CPU 44 transmitting an activate signal to the driver circuitry 70 to prepare the driver circuitry 70 for receipt of data to be displayed on display 24. Additionally, the initialization of the LCD in step 88 may include transmitting the type of data to be displayed, here slowly changing image data, such as images associated with a text message, so that the driver circuitry 70 may be placed into the correct display mode. The initialization signals may be transmitted over the low speed data connection of the data path 58.

In step 90, the driver circuitry 70 may receive the image data of the type communicated by the CPU 44 in step 78, for example, slowly changing image data such as images associated with a text message. The image data may correspond to pixel lines in the display 24, and may be transmitted across the data path 58. Once received, the driver circuitry 70 may determine if the voltage values correspond to an initial frame to be displayed in step 92.

When the driver circuitry 70 determines that the voltage values correspond to an initial frame to be displayed, the driver circuitry 70, in step 94, may store a copy of all of the voltage values used to create the entire frame in the frame buffer 72. In this manner, the image data used to create a full image frame on the display 24 may be stored in the frame buffer. The driver circuitry 70, in step 96, may then use the stored image data to control one or more of the lighting circuitry 60, the bottom glass 62, the film 66 and/or the top glass 68 to twist and untwist the liquid crystals 64 to allow the requisite amount of light to pass through the top glass 68 to generate and display a pixelated image on the display 24. However, other frames may follow for display on the display 24.

Accordingly, in step 98, the driver circuitry 70 may determine if any subsequent frames are to be displayed. This may occur by the driver circuitry 70 transmitting an image data request to the CPU 44. If no other frames are to be displayed, the driver circuitry 70 may power down the display 24 and/or put the display 24 into a sleep mode in step 100. If, however, further images are to be displayed, the driver circuitry 70 may return to step 90 to receive new voltage values.

If, in step 92, the driver circuitry 70 determines that the voltage values do not correspond to an initial frame to be displayed, the driver circuitry 70 may proceed to step 102. This may occur when the CPU 44 transmits only voltage values for pixels that differ between the previously transmitted image data and the current image data. For example, from one image frame to the next, 95% of the pixels may display the same amount of light at the same brightness and color from one frame to the next. In this example, the CPU 44 would only transmit new voltage values for the 5% of pixels that are to be changed in brightness, color, or some other optical feature. In this manner, fewer voltage signals may be generated and transmitted across the speed data path 58. Accordingly, the low speed data connection of data path 58 may be utilized to transmit, for example, the new image data associated with the slowly changing image data. It should be noted that advantages in utilizing the low speed data connection for this transmission, include less power consumed than would be consumed by transmitting the data across the high speed data connection of data path 58.

In step 102, the driver circuitry 70 may process the received image data, that is, the driver circuitry 70 may determine which pixel values have been transmitted by the CPU 44. The received voltage values and the previously stored voltage values in the frame buffer 72 may be combined by the driver circuitry 70 and stored in the frame buffer 72.

One method to combine the voltage values includes overwriting the stored voltage values that were retrieved with the received voltage values to form a full frame. Another method to combine the voltage values may include retrieving the stored voltage values that do not correspond to received voltage values, and combining the retrieved values with the received values to form a full frame. Regardless of the method implemented, a full image data frame is stored in step 104.

The stored image data of step 104 may then be utilized by the driver circuitry 70, in step 106, to generate and display images by controlling one or more of the lighting circuitry 60, bottom glass 62, film 66 and/or the top glass 68 to twist and untwist the liquid crystals 64 to allow the requisite amount of light to pass to the top glass 68 to generate a pixelated image on the display 24.

The driver circuitry 70 may then determine if any subsequent frames are to be displayed in step 98, whereby the driver circuitry 70 transmits an image data request to the CPU 44. If no other frames are to be displayed, the driver circuitry 70 may power down the display 24, and/or put the display 24 into a sleep mode in step 100. If, however, further images are to be displayed, the driver circuitry 70 may return to step 90 to receive new voltage values and begin the process anew.

Specific embodiments have been shown by way of example in the drawings and have been described in detail herein. However, it should be understood that the claims are not intended to be limited to the particular forms disclosed. Rather, the claims are to cover all modifications, equivalents, and alternatives falling within their spirit and scope.

What is claimed is:

1. A method of generating images, comprising: initializing driver circuitry in a display to receive image data corresponding to voltages to be delivered to pixels in the display at a first display refresh rate;

transmitting the image data from a processor in an electronic device in which the display is located;

receiving the image data at the driver circuitry;

storing the image data in a frame buffer located in the driver circuitry;

generating a first image for display on the display based on the image data;

wherein when the image data is transmitted using a burst transmission over a high speed data connection, generating the first image for display comprises refreshing the first image at a second display refresh rate greater than the first display refresh rate;

when the image data is transmitted using a transmission over a low speed data connection, generating the first image for display comprises refreshing the first image at the first display refresh rate;

wherein the burst transmission comprises transmitting multiple frames of voltages that correspond to the first display refresh rate of the display during a first time period and allowing the processor to idle during a second time period; and displaying the first image on the display.

2. The method of claim 1, wherein initializing the driver circuitry comprises notifying the driver circuitry of the type of image data to be displayed on the display.

3. The method of claim 1, comprising transmitting an image data request from the display circuitry to the processor when the multiple frames of voltages to be delivered to the pixels in the display have been utilized to generate multiple images for display on the display.

4. The method of claim 3, comprising transmitting secondary image data at the first display refresh rate in the burst transmission from the processor in response to the image data request, wherein the secondary image data corresponds to a second set of multiple frames of voltages to be delivered to the pixels in the display.

5. The method of claim 1, comprising performing a frame inversion for the display once a frame at the second display refresh rate.

6. The method of claim 5, wherein the first display refresh rate is equal to 30 Hz and the second display refresh rate is equal to either 90 Hz or 120 Hz.

7. A display comprising: image generating circuitry adapted to generate a first image on the display;

a frame buffer located in the display and adapted to store voltage values corresponding to the first image to be generated on the display; and driver circuitry located in the display and adapted to:

control the image generating circuitry and the frame buffer;

receive the voltage values corresponding to the first image to be generated on the display;

transmit the voltage values to the display to generate an image for display on the display from a processor, wherein generating the image for display comprises refreshing the image at a first display refresh rate when the voltage values comprise a first amount of data transmitted using a transmission over a low speed data connection;

wherein generating the image for display comprises refreshing the image at a second display refresh rate greater than the first display refresh rate when the voltage values comprise a second amount of data greater than the first amount of data transmitted using a burst transmission over a high speed data connection, wherein the burst transmission comprises transmitting multiple frames of voltages that correspond to the first display refresh rate of the display during a first time period and allowing the processor to idle during a second time period; and perform a frame inversion for the display once a frame.

8. The display of claim 7, wherein the frame inversion comprises modulating a voltage transmitted to all pixels in the display.

9. The display of claim 7, wherein the driver circuitry is adapted to receive a second set of voltage values, wherein the second set of voltage values correspond to pixel voltage values to be changed from generation of the first image to generation of a second image.

10. The display of claim 9, wherein the driver circuitry is adapted to process the second set of voltage values with the voltage values to produce a pixel voltage frame corresponding to pixel voltage values for each of a plurality of pixels in the display.

11. The display of claim 10, wherein image generating circuitry is adapted to generate the second image on the display based on the pixel voltage frame.

12. The display of claim 10, wherein the frame buffer is adapted to overwrite the first set of voltage values with the pixel voltage frame.

13. The display of claim 10, wherein processing the second set of voltage values with the first set of voltage values comprises overwriting the voltage values with the second set of voltage values at any overlapping pixel locations.

14. The display of claim 7, wherein the frame buffer is adapted to store voltage values corresponding to a second image to be generated on the display concurrently with the voltage values corresponding to the first image.

15. The display of claim 14, wherein the voltage values corresponding to the first image and the voltage values corresponding to the second image are received by the display circuitry as part of the first time period of the burst transmission.

16. The display of claim 7, wherein the frame buffer comprises a static random access memory.

17. An electronic device, comprising: a processor adapted to transmit image data as a transmission over a low speed data connection and in a burst transmission over a high speed data connection, wherein the burst transmission comprises transmitting multiple frames of voltages that correspond to the first display refresh rate of the display during a first time period and allowing the processor to idle during a second time period; and a display, wherein the display comprises:

a frame buffer adapted to store voltage values corresponding to a plurality of images to be generated on the display; and driver circuitry adapted to:

generate images for display on the display;

wherein when the image data is transmitted using the burst transmission over a high speed data connection, generating the images for display comprises refreshing the images at a second display refresh rate greater than the first display refresh rate;

when the image data is transmitted using the transmission over a low speed data connection, generating the images for display comprises refreshing the images at the first display refresh rate;

perform a frame inversion for the display once a frame; and update the frame buffer with secondary voltage received via a second burst transmission from the processor, wherein the secondary values correspond to a second plurality of images to be generated on the display.

18. The electronic device of claim 17, wherein the driver circuitry is adapted to transmit an image data request to the processor when voltage values corresponding to a plurality of images to be generated on the display have been utilized to generate multiple images for display on the display.

19. The electronic device of claim 17, wherein the first display refresh rate is equal to 30 Hz and the second display refresh rate is equal to either 90 Hz or 120 Hz.

20. A method of generating an image, comprising: initializing driver circuitry in a display to receive image data corresponding to voltages to be delivered to pixels in the display at a first display refresh rate;

transmitting voltage values from a processor as a transmission over a low speed data connection and in a burst transmission over a high speed data connection, wherein the voltage values correspond to multiple frames of voltages to be delivered to pixels in a display, and wherein the burst transmission comprises transmitting the multiple frames of voltages that correspond to the first display refresh rate of the display during a first time period and allowing the processor to idle during a second time period;

storing the multiple frames of voltages in a frame buffer located on the display, wherein the frame buffer comprises a static random access memory;

generating a first image for display on the display wherein when the image data is transmitted as the burst transmission over a high speed data connection, generating the first image for display comprises refreshing the first image at a second display refresh rate greater than the first display refresh rate;

when the image data is transmitted as the transmission over a low speed data connection, generating the first image for display comprises refreshing the first image at the first display refresh rate; and displaying the first image on the display.

21. The method of claim 20, comprising performing a frame inversion for all the pixels in the display for every image displayed at the second display refresh rate.

22. The method of claim 21, wherein performing the frame inversion comprises generating a modulated voltage and transmitting the modulated voltage to all pixels in the display.

23. The method of claim 20, comprising transmitting second voltage values corresponding to new pixel values for any pixels to be changed from the voltage values transmitted in the burst transmission.

24. The method of claim 23, comprising overwriting the voltage values stored in the frame buffer with a combination of the stored voltage values and the second voltage values.

* * * * *